US008944844B2

(12) United States Patent
Myer

(10) Patent No.: US 8,944,844 B2
(45) Date of Patent: Feb. 3, 2015

(54) CONNECTOR MATING ASSURANCE

(71) Applicant: Tyco Electronics Corporation, Berwyn, PA (US)

(72) Inventor: John Mark Myer, Millersville, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 31 days.

(21) Appl. No.: 13/745,182

(22) Filed: Jan. 18, 2013

(65) Prior Publication Data

US 2014/0206225 A1 Jul. 24, 2014

(51) Int. Cl.

| | |
|---|---|
| ***H01R 13/62*** | (2006.01) |
| ***H01R 13/641*** | (2006.01) |
| *H01R 13/46* | (2006.01) |
| *H01R 13/627* | (2006.01) |
| *H01R 107/00* | (2006.01) |

(52) U.S. Cl.

CPC ..... *H01R 13/641* (2013.01); *H01R 13/465* (2013.01); *H01R 13/6272* (2013.01); *H01R 2107/00* (2013.01)

USPC ..... 439/489

(58) Field of Classification Search

CPC ..... H01R 13/341

USPC ..... 439/489

See application file for complete search history.

(56) References Cited

U.S. PATENT DOCUMENTS

| | | | | | |
|---|---|---|---|---|---|
| 3,960,428 | A * | 6/1976 | Naus et al. | 439/315 |
| 4,687,271 | A * | 8/1987 | Szoboszlai et al. | 439/350 |
| 4,861,276 | A * | 8/1989 | Muller et al. | 439/365 |
| 4,925,402 | A * | 5/1990 | Inaba et al. | 439/490 |
| 5,067,909 | A * | 11/1991 | Behning | 439/315 |
| 5,194,016 | A * | 3/1993 | Hatagishi et al. | 439/489 |
| 5,667,403 | A * | 9/1997 | Fukuda et al. | 439/489 |
| 5,785,546 | A * | 7/1998 | Hamai et al. | 439/354 |
| 5,903,132 | A * | 5/1999 | Ohira et al. | 320/107 |
| 6,162,082 | A * | 12/2000 | Karsten et al. | 439/318 |
| 6,561,841 | B2 * | 5/2003 | Norwood et al. | 439/489 |
| 6,811,423 | B2 * | 11/2004 | Yoshigi et al. | 439/315 |
| 7,025,624 | B2 * | 4/2006 | Kiyota et al. | 439/489 |
| 7,470,144 | B2 * | 12/2008 | Murata et al. | 439/489 |
| 7,497,723 | B2 * | 3/2009 | Brassell et al. | 439/489 |
| 7,544,086 | B1 * | 6/2009 | Wells | 439/489 |
| 7,931,490 | B2 * | 4/2011 | Pellen | 439/489 |
| 8,235,292 | B2 * | 8/2012 | Talboys | 235/462.1 |
| 8,556,651 | B1 * | 10/2013 | Heitmann et al. | 439/489 |
| 8,651,892 | B2 * | 2/2014 | Arant | 439/489 |
| 2013/0288516 | A1 * | 10/2013 | Chang et al. | 439/488 |

FOREIGN PATENT DOCUMENTS

| | | |
|---|---|---|
| JP | 2011 082029 A | 4/2011 |
| JP | 2012 038570 A | 2/2012 |

OTHER PUBLICATIONS

International Search Report, International Application No. PCT/US2014/010167, International Filing Date, Jan. 3, 2014.

* cited by examiner

*Primary Examiner* — Neil Abrams

(57) ABSTRACT

An electrical connector for mating with a mating electrical connector. The electrical connector has a surface having a first reference member and a latch having a second reference member. The first reference member and the second reference member are positioned to indicate when the electrical connector is fully mated to the mating electrical connector.

12 Claims, 5 Drawing Sheets

CONNECTOR MATING ASSURANCE

FIELD OF THE INVENTION

The present invention is directed to an electrical connector which has reference members to assure that the mating connectors are properly mated.

BACKGROUND OF THE INVENTION

In certain applications, electronic components require an electrical connector assembly that joins first and second housings containing electrical contacts. One housing includes male electrical contacts, while the other housing includes female electrical contacts. The first housing is configured to be received inside the second housing such that the male and female electrical contacts are electrically connected. In a traditional electrical connector assembly, the first housing is connected to the second housing by hand. In order to be sure that the first and second housings are properly connected with the electrical contacts electrically engaged, the first and second housing are provided with a latch assembly more generally referred to as a position assurance feature. The latch assembly includes a base plate and a suspended prong on the first housing and a ramp on the second housing. The base plate is slidably retained beside the prong. When the first housing is inserted about the second housing, the prong snaps over the ramp and the base plate is then slid over the ramp and the prong into an engagement position. An audible click is typically used to detect if the connector is fully mated, however, noise at the assembly plant can make this ineffective.

Additionally, electrical connectors have been proposed that utilize a latch or retention assembly to maintain connector halves in a fully mated position, along with a connector position assurance (CPA) device. When the connector halves are mated and the latch or retention assembly is positioned to maintain contact between the connector halves, the CPA device is moved to a position that indicates the connector halves are properly connected. Thus, the CPA device provides a means to assure that the connector halves are fully mated.

However, even with these latches and CPAs, the largest warranty problem with automotive connectors is that the connectors are not fully mated, causing system failures after the automobile has left the assembly plant. This is due to the fact that at the vehicle assembly plant, some connectors are mated far enough to make initial, electrical contact but the latches of the connectors are not fully engaged causing the connectors to not be locked or secured together. These connectors later come apart in the field, as the vehicle is driven on bumpy roads etc. causing loss of system function. Presently, as described above, an audible click type locking system is typically used to detect if the connector is fully mated. However, due to noise levels at the assembly plant, the operator cannot hear the click, rendering the locking system ineffective. Incorporating CPAs into the connectors does not guarantee that the connectors will be properly mated and secured, as in many instances the operator does not properly activate the CPAs.

It would be beneficial to have mating connectors which overcome the problems identified above and which provide a visual means to assure that the connectors are properly mated prior to leaving the assembly plant.

SUMMARY OF THE INVENTION

An embodiment of the invention is directed to an electrical connector for mating with a mating electrical connector. The electrical connector has a surface having a first reference member and a latch having a second reference member. The first reference member and the second reference member are positioned to provide an indication when the electrical connector is fully mated to the mating electrical connector.

An embodiment of the invention is also directed to an electrical connector for mating with a mating electrical connector. The electrical connector includes a surface having a first reference member and a latch having a second reference member. The first reference member and the second reference member being aligned when the electrical connector is fully mated to the mating electrical connector. The first reference member and the second reference member being offset when the electrical connector is partially mated to the mating electrical connector.

An embodiment of the invention is also directed to an electrical connector for mating with a mating electrical connector. The electrical connector includes a mating end and a rearward end. A first surface and an oppositely facing second surface extend between the mating end and the rearward end. A first reference member is provided on the rearward end, the first reference member spaced a first distance from the first surface. A latch is provided, the latch having a second reference member provided on an end of the latch. The latch being resiliently deformable as the electrical connector is mated with the mating electrical connector. The first reference member and the second reference member being aligned when the electrical connector is fully mated to the mating electrical connector, and the first reference member and the second reference member being offset when the electrical connector is partially mated to the mating electrical connector.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
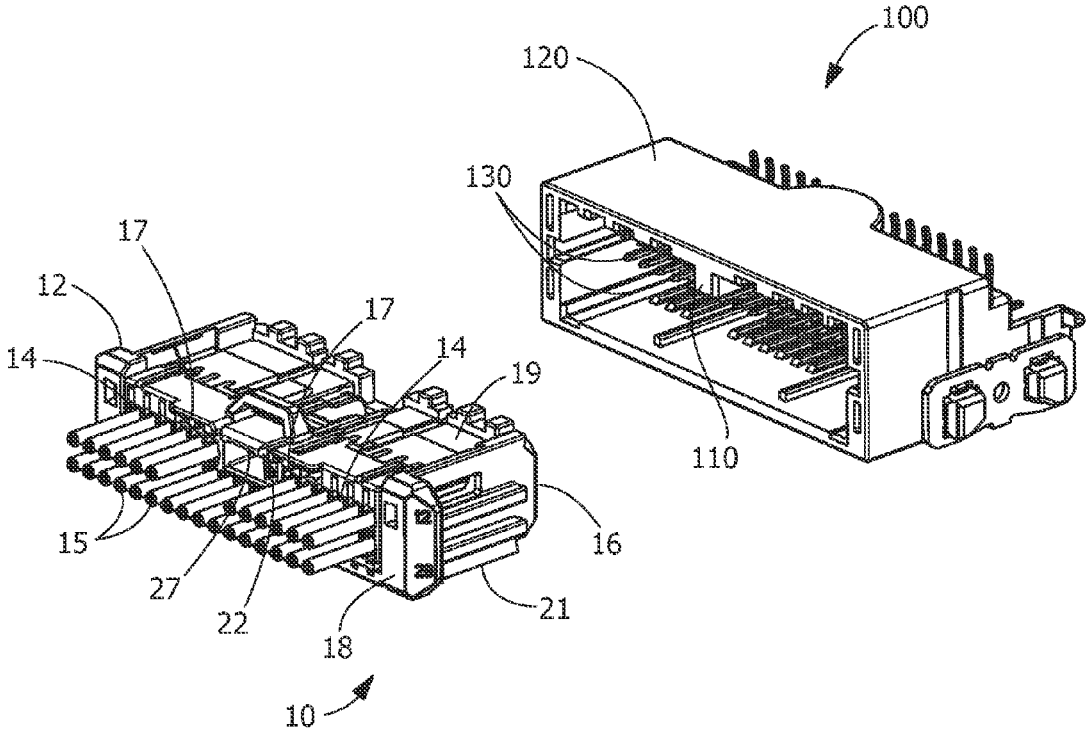
FIG. 1 is a perspective view of a connector prior to mating with a mating connector.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

FIG. 1 shows a perspective view of an electrical connector or plug 10 mated with a mating connector or header 100 which together form a connector assembly. The electrical connector 10 and mating connector 100 are shown as a representations. The connectors 10 and 100 will have many other features, such as contacts and contact latches, which are not shown in FIG. 1.

Referring to FIG. 1, the electrical connector 10 has a housing body 12 with contact receiving passages 14 for receiving contacts therein, not shown. The electrical connector 10 has a forward mating end 16 and a rearward end 18. Conductors or wires 15, which are in electrical engagement with the contacts (not shown) inserted in the passages 14, extend from the rearward end 18. A first or top surface 19 and an oppositely facing second or bottom surface 21 extend between the mating end 16 and the rearward end 18.

As best shown in FIG. 1, reference areas or members 17 are marked or provided on the rearward end 18 of the connector 10. In the embodiment shown, the reference members 17 are two surfaces with reference lines which are spaced an equal or approximately equal distance from the top surface 19 of the connector 10. While two reference members are shown, other numbers of reference members 17 may be used. Additionally, the reference members 17 may be, but are not limited to, textured areas or raised areas which extend beyond the rearward end 18.

Figure 3:
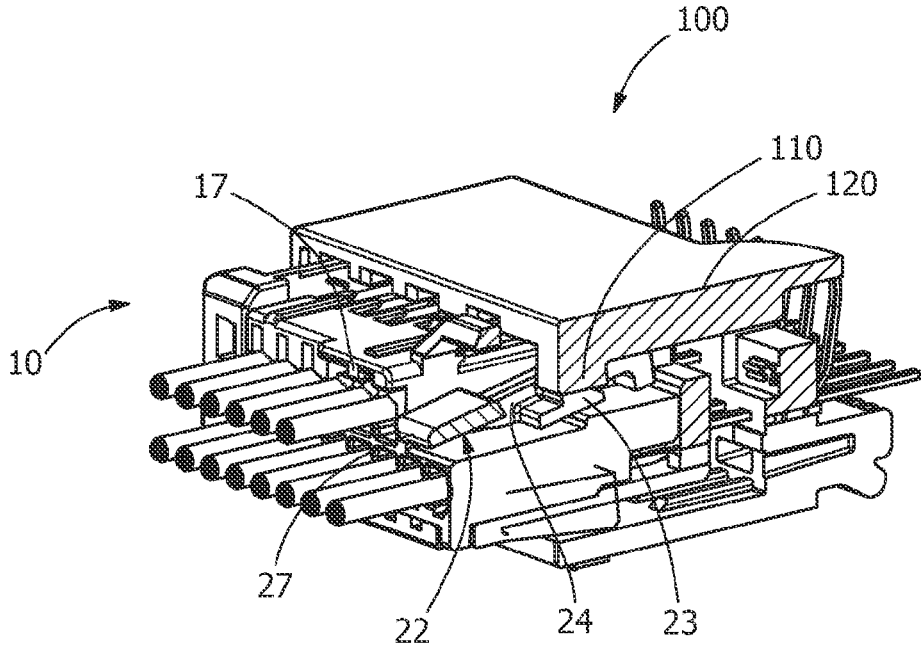
FIG. 3 is a cross-sectional view of the connector and the mating connector of FIG. 2, showing the position of the latch.
Figure 5:
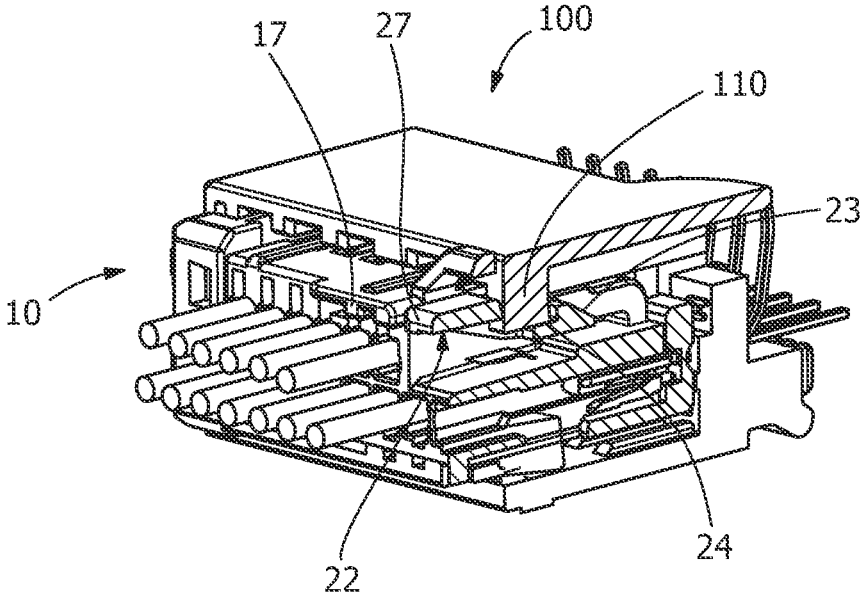
FIG. 5 is a cross-sectional view of the connector and the mating connector of FIG. 4, showing the position of the latch.

Referring to FIGS. 3 and 5, a latch or latch arm 22 having an engagement surface 23 and a latching opening 24 extends from the top surface 19. In the embodiment shown, the latch 22 is connected to the top surface 19 proximate the forward mating end 16 and extends toward the rearward end 18. The latch 22 is used to latch and secure the mating connector 100 to the connector 10, as will be more fully described below. The mating connector 100 has a complimentary latching protrusion 110 which engages with the latching opening 24 to secure the mating connector 100 with the electrical connector 10. In the embodiment shown, the latching protrusion extends from a surface of a shroud 120 of the mating connector 100.

A reference member 27 is marked or provided on the ends of the latches 22. In the embodiment shown, the reference member 27 is a surface with a reference line. While one line is shown, other numbers of reference members 27 may be used. Additionally, the reference member 27 may be, but is not limited to, a textured area or a raised area which extends beyond the rearward end 18 of the connector 10.

When the electrical connector 10 is mated with the mating connector 100, the connector 10 is received within the shroud 120 of the mating connector 100. The mating connector 100 will have a series of electrical contacts 130 (FIG. 1) secured therein to mate with the electrical contacts in the electrical connector 10.

FIG. 1 shows a perspective view of the electrical connector 10 prior to being inserted into shroud 120 of the mating connector 100. The latch 22 is shown in the prelatch position. In this position, latch 22 is in a normal or undeflected position. With the latch 22 in an undeflected position, the reference member 27 of the latch 22 is aligned in a straight line with the reference members 17 of the rearward end 18.

Figure 2:
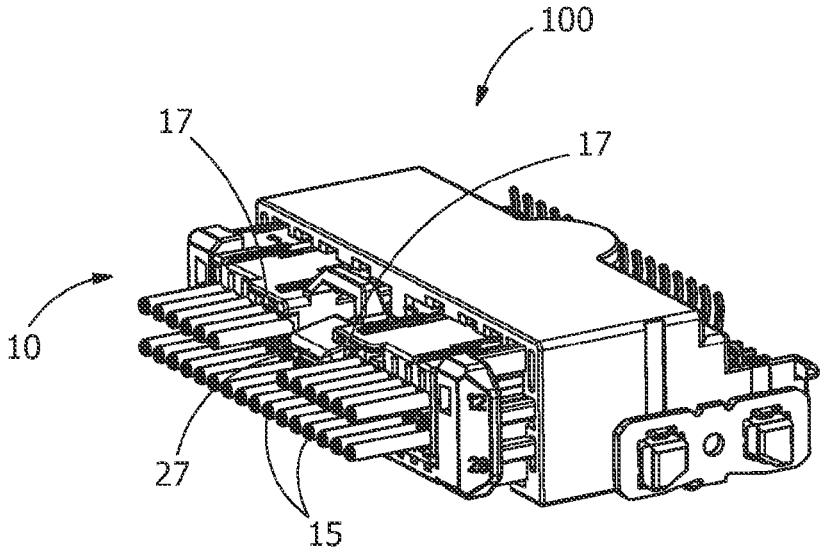
FIG. 2 is a perspective view the connector and the mating connector of FIG. 1 shown in a partially mated position.

When the connector 10 is partially inserted into the shroud 120 of the mating connector 100, as shown in FIGS. 2 and 3, the engagement surface 23 of the latch 22 engages the latching protrusion 110 of the mating connector 100, causing the engagement surface 23 and the latch 22 to be resiliently deformed away from the top surface 19 of the connector 10 toward the bottom surface 21 of the connector 10. As this occurs, the reference member 27 of the latch 22 is moved toward the bottom surface 21, causing the reference member 27 to be moved out of alignment with the reference members 17. This provides a visual indication that the connector 10 and mating connector 100 are not fully mated together.

Figure 4:
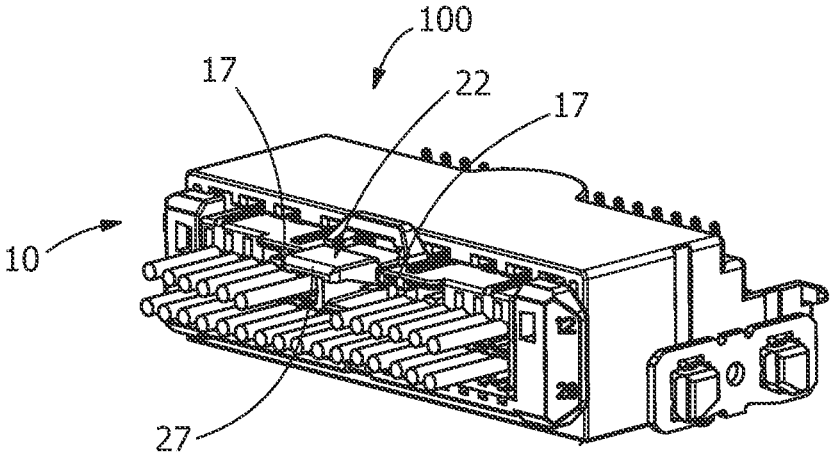
FIG. 4 is a perspective view the connector and the mating connector of FIG. 1 shown in a fully mated position.

Upon complete insertion of the connector 10 in the mating connector 100, as shown in FIGS. 4 and 5, the engagement surface 23 will be moved beyond the latching protrusion 110. In this position, the latching protrusion 110 is aligned with the opening 24 of the latch 22, allowing the latch 22 to resile to its normal, undeflected position, thereby latching the latch 22 on the latching protrusion 110 to secure the connector 10 to the mating connector 100. In this position, the reference member 27 is returned to a position in which the reference member 27 and the reference members 17 are in alignment, providing a visual indication that the connector 10 and mating connector 100 are fully mated.

In the embodiment shown in FIGS. 1 through 5, when the latch 22 is deflected in the partially mated position, the deflection of reference member 27 relative to the reference members 17 is in excess of 2 mm. This deflection allows the operator to visually determine if the connectors 10, 100 are fully mated or only partially mated. Alternatively a scanner or the like can be used to determine if the reference members 17, 27 are properly aligned and the connectors 10, 100 properly mated or if the reference members 17, 27 are not properly aligned and the connectors 10, 100 are not properly mated. While the embodiment shown refers to a distance of 2 mm between the fully mated and partially mated positions, other dimensions may be used.

During assembly, if the connector 10 is not completely inserted or is improperly inserted into the mating connector 100, the latch 22 will continue to be deflected from its normal, undeflected position, thereby providing an indication to the operator that the connector 10 is not properly inserted within the mating connector 100 and this must be corrected.

Once the position of the connector 10 has been corrected, relative to the mating connector 100, the latch 22 will resile to its normal position thereby ensuring that the connector 10 and mating connector 100 are fully mated and secured.

As previously stated, the difference in reference member 27 and the reference members 17 in the "partially mated" position versus the "fully mated" is measurable. This allows the reference members 17, 27 to be easily detectable by either the human eye, a bar code type reader, a UV scanner or other device, thereby allowing for a positive indication to assure that the connector 10 is fully mated to mating connector 100.

For example, if ink of a contrasting color, laser marking and/or a UV tracer are used for the reference members, a hand held scanner can be used to determine if the connectors 10, 100 are fully mated even in blind mate areas under the dash board. As the reference members are located at the rear face of rearward end 18 of the connector 10, the reference members will always be accessible, as the rearward end 18 and the conductors 15 must be accessible for service and the like. Alternatively, a scanner could be electronically linked to the assembly plant inspection system to document that each operator has fully mated the connectors.

For less critical connections or those more easily detected by visual inspection, a less expensive alternative to printing the highlighted lines with ink on the reference members or to mark the lines with a laser would be to texture the highlighted lines in the mold or to raise the surfaces of the highlighted members to extend beyond the rear of the housing for easy visual detection, as shown in FIGS. 6 through 9.

Figure 6:
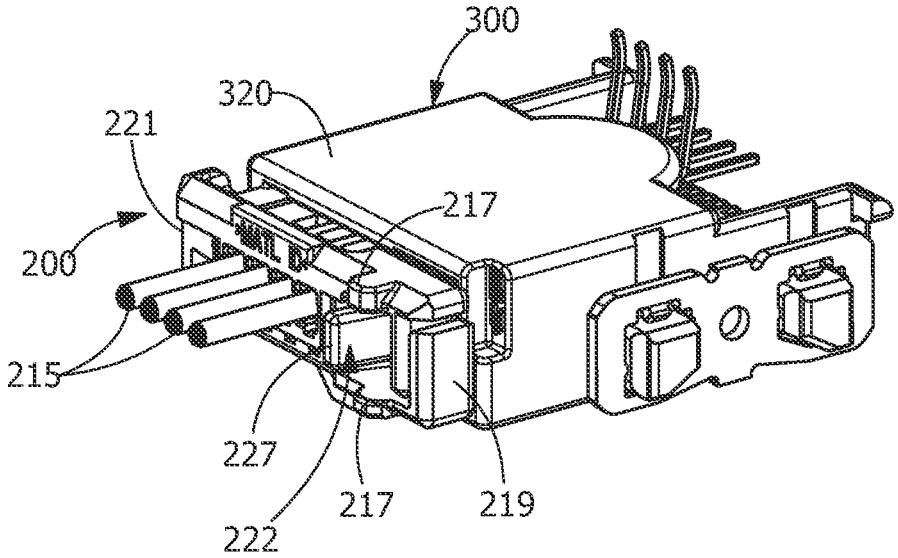
FIG. 6 is a perspective view an alternate connector and mating connector shown in a partially mated position.
Figure 7:
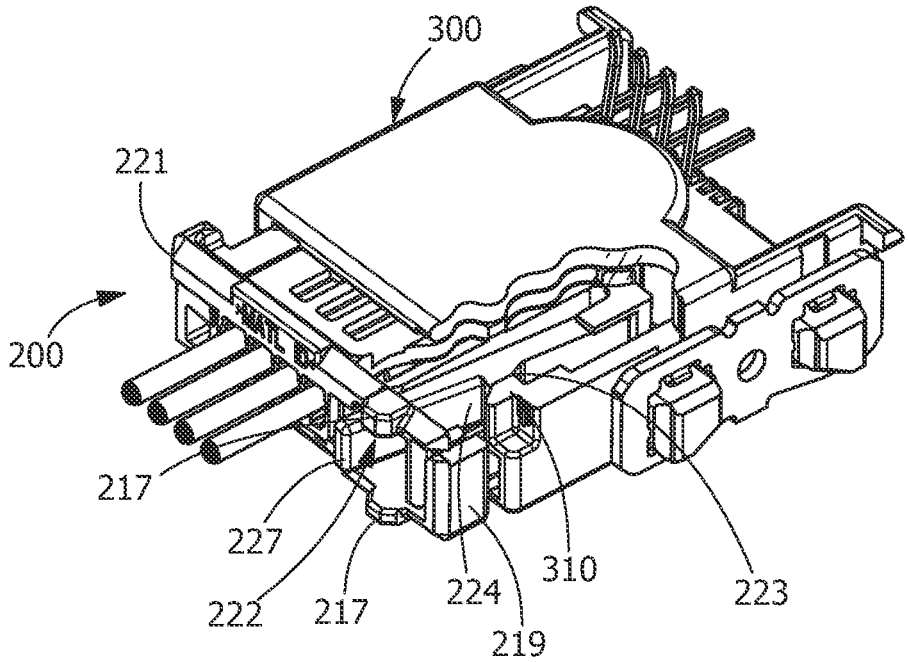
FIG. 7 is a cross-sectional view of the connector and the mating connector of FIG. 6, showing the position of the latch.

Referring to FIGS. 6 and 7, when the connector 200 is partially inserted into the shroud 320 of the mating connector 300, the engagement surface 223 of the latch or latch arm 222 engages the latching protrusion 310 of the mating connector 300, causing the engagement surface 223 and the latch 222 to be resiliently deformed away from a side surface 219 of the connector 10 toward an opposed surface 221 of the connector 200. As this occurs, the reference member 227 of the latch 222 is moved toward the opposed side surface 221, causing the reference member 227 to be moved out of alignment with the reference members 217. As the reference members 217, 227 are molded to extend beyond a rear surface of the connector 200, a visual indication that the connector 200 and mating connector 300 are not fully mated together is provided.

Figure 8:
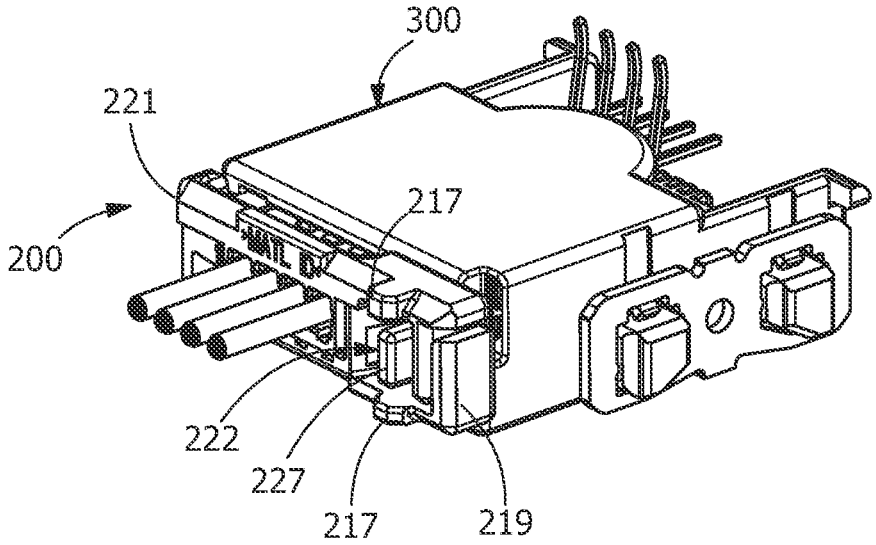
FIG. 8 is a perspective view the connector and the mating connector of FIG. 6 shown in a fully mated position.
Figure 9:
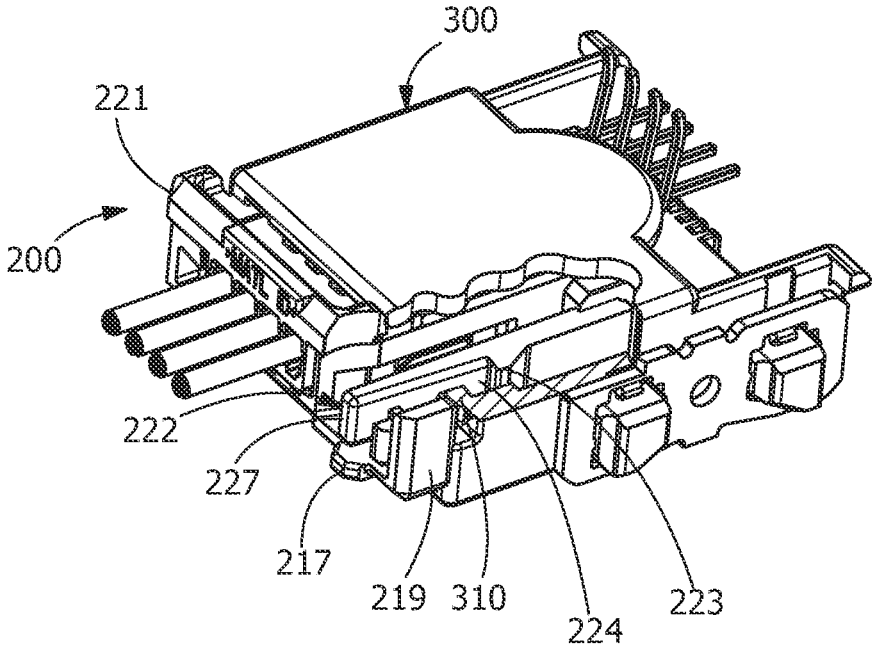
FIG. 9 is a cross-sectional view of the connector and the mating connector of FIG. 8, showing the position of the latch.

Upon complete insertion of the connector 200 in the mating connector 300, as shown in FIGS. 8 and 9, the engagement surface 223 will be moved beyond the latching protrusion 310, allowing the latch 222 to resile to its normal, undeflected position, thereby latching the latch 222 on the latching protrusion 310 to secure the connector 200 to the mating connector 300. In this position, the reference member 227 is returned to a position in which the reference member 227 and the reference members 217 are in alignment, providing a visual indication that the connector 200 and mating connector 300 are fully mated.

The use of reference members can be applied to existing connector designs. Ink reference lines or laser applied reference lines may be applied to existing designs to provide the visual reference desired to assure proper mating. Alternatively, with minimal changes to existing molds, current connector designs may be modified to include raised or textured areas on the connector body and the latch to act as reference members.

The use of reference members is not limited to connector mating assurance members with latches. For example, reference members can also be used with connector position assurance (CPA) devices, mechanical assist levers or such similar devices. Similar to that described above, when used with a CPA, references members are provided on the CPA and on the surface of the connector body on which the CPA is positioned. The alignment of the reference members provides an indication that the CPA is properly positioned.

While the reference members have been described above, other embodiments may be used without departing from the scope of the invention. As an example, other visuals may be used to indicate that the connectors are mated together. While providing the reference members in alignment facilitates visual inspection, other configuration may be used as long as the positioning of the reference members is properly controlled.

While the invention has been described with reference to a preferred embodiment, it will be understood by those skilled in the art that various changes may be made and equivalents may be substituted for elements thereof without departing from the spirit and scope of the invention of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector for mating with a mating electrical connector, the electrical connector comprising:

a housing body having a rearward end, the rearward end having a first reference member provided thereon, the first reference member being raised to extend beyond the rearward surface;

a resilient latch arm having an engagement surface which cooperates with a latching protrusion of the mating electrical connector to move the latch arm between a first position and a second position, the latch arm having a second reference member provided thereon, the second reference member being raised to extend beyond the rearward surface;

wherein the first reference member and the second reference member are aligned to provide a visual indication that the electrical connector and the mating electrical connector are mated when the electrical connector is fully mated to the mating electrical connector and wherein the first reference member and the second reference member are not aligned to provide a visual indication that the electrical connector and the mating electrical connector are not mated when the electrical connector is not fully mated to the mating electrical connector.

2. The electrical connector as recited in claim 1, wherein the first reference member and the second reference member have markings applied thereto to provide a visual contrast between the surface of the electrical connector and the first and second reference members.

3. The electrical connector as recited in claim 1, wherein the second reference member is offset from the first reference member by a distance of more than approximately 2 mm when the electrical connector is partially mated to the mating electrical connector.

4. The electrical connector as recited in claim 1, wherein the first reference member and the second reference member have line segments provided thereon, whereby the line segments form a continuous line when the electrical connector is fully mated to the mating electrical connector.

5. The electrical connector as recited in claim 1, wherein the first reference member has two surfaces with reference lines which are spaced an approximately equal distance from a top surface of the electrical connector.

6. An electrical connector for mating with a mating electrical connector, the electrical connector comprising:

a housing body having a rearward end, the rearward end having a first reference member provided thereon, the first reference member being raised to extend beyond the rearward surface;

a resilient latch arm having an engagement surface which cooperates with a latching protrusion of the mating electrical connector to move the latch arm between a first position and a second position, the latch arm having a second reference member provided thereon, the second reference member being raised to extend beyond the rearward surface;

the first reference member and the second reference member being aligned when the electrical connector is fully mated to the mating electrical connector; and the first reference member and the second reference member being offset when the electrical connector is partially mated to the mating electrical connector.

7. The electrical connector as recited in claim 6, wherein the first reference member and the second reference member have printing applied thereto to provide a visual contrast between the surface of the electrical connector and the first and second reference members.

8. The electrical connector as recited in claim 6, wherein the second reference member is offset from the first reference member by a distance of more than approximately 2 mm when the electrical connector is partially mated to the mating electrical connector.

9. The electrical connector as recited in claim 6, wherein the first reference member and the second reference member have line segments provided thereon, whereby the line segments form a continuous line when the electrical connector is fully mated to the mating electrical connector.

10. An electrical connector for mating with a mating electrical connector, the electrical connector comprising:

a mating end and a rearward end;

a first surface and an oppositely facing second surface, the first and second surface extend between the mating end and the rearward end;

a first reference member provided on the rearward end, the first reference member spaced a first distance from the first surface, the first reference member being raised to extend beyond the rearward surface;

a resilient latch arm, the latch arm having a second reference member provided on an end of the latch arm, the latch arm being resiliently deformable as the electrical connector is mated with the mating electrical connector, the second reference member being raised to extend beyond the rearward surface;

the first reference member and the second reference member being aligned when the electrical connector is fully mated to the mating electrical connector; and the first reference member and the second reference member being offset when the electrical connector is partially mated to the mating electrical connector.

11. The electrical connector as recited in claim 10, wherein the first reference member and the second reference member have markings applied thereto to provide a visual contrast between the rearward end of the electrical connector and the first and second reference members.

12. The electrical connector as recited in claim 10, wherein the first reference member and the second reference member have line segments provided thereon, whereby the line segments form a continuous line when the electrical connector is fully mated to the mating electrical connector.

* * * * *